United States Patent [19]

Ecchuya

[11] 3,974,532

[45] Aug. 17, 1976

[54] PADDING FOR MATTRESSES AND LIKE ARTICLES

[75] Inventor: Masao Ecchuya, Inagi, Japan

[73] Assignee: Mitsuyoshi Hamasu, Tokyo, Japan

[22] Filed: Mar. 10, 1975

[21] Appl. No.: 556,942

[52] U.S. Cl. ..... 5/345 R; 5/344; 5/91; 5/352

[51] Int. Cl.[2] ..... A47C 27/08

[58] Field of Search ..... 5/91, 343–345, 5/348, 352, 355

[56] References Cited

UNITED STATES PATENTS

| | | | |
|---|---|---|---|
| 2,532,425 | 12/1950 | Schenken | 5/91 |
| 3,626,526 | 6/1969 | Viel | 5/345 R |
| 3,737,929 | 6/1973 | Golembeck | 5/345 R |
| 3,885,257 | 5/1975 | Rogers | 5/345 R |
| 3,885,258 | 5/1975 | Regan | 5/361 B |
| 3,885,259 | 5/1975 | Cheony | 5/347 |

*Primary Examiner*—Casmir A. Nunberg
*Attorney, Agent, or Firm*—Diller, Brown, Ramik & Wight

[57] ABSTRACT

Padding for mattresses, cushions, pillows etc. comprises a soft board-like base member and a plurality of elongated padding members disposed in parallel relationship on the base member. The construction provides the mattress with a proper hardness and flexibility and enables the sleeper to maintain an ideal sleeping posture. The elongated padding members may be provided with small projections to give a moderate stimulus to the human body, and may be formed with perforations for ventilation. The elongated padding members may be provided on both sides of the base member and the elongated padding members provided on one side may be offset from those provided on the other side to increase cushion effect.

8 Claims, 10 Drawing Figures

PADDING FOR MATTRESSES AND LIKE ARTICLES

This invention relates to padding for mattresses and like articles such as cushions, pillows, sofas and arm chairs.

In recent years there is a growing tendency in furniture industries to use a very soft synthetic resin such as foamed polyurethane as padding for mattresses, cushions, etc. Taking a mattress for example, this type of soft synthetic resin padding is disadvantageous in that the support of the human body by the padding as shown in FIG. 1 (A) is so unstable that a person who sleeps on a mattress stuffed with this type of padding unconsciously moves his muscles during sleep to assume as natural a posture as possible and this sometimes prevents him from enjoying a sound sleep. The mattress with the conventional soft padding is also demeritorius because the sleeper's body sinks in the mattress and he must make some unconscious effort for turning sides on this type of mattress. Furthermore, the area of contact between the sleeper's body and the mattress is relatively large because his body sinks in the mattress and this hampers skin respiration with a resultant increase in sultriness in summer.

Medical studies on sleep have revealed that it is an essential condition for an ideal sleeping posture to sleep without burdening one's small of the back. This ideal sleeping posture is illustrated in FIG. 1(B). A medical study reports that if a person sleeps on the mattress stuffed with the soft synthetic resin padding, his hip sinks in the mattress and his small of the back is stretched with a result that muscles of the small of the back cannot rest. In the worst case, persons such as patients and old people who lie on the bed for many hours a day suffer from lumbago.

It is, therefore, an object of the present invention to provide padding for mattresses and like articles which has eliminated the above described disadvantages of the conventional mattresses etc.

It is another object of the invention to provide padding which consists of a soft board-like base member and a plurality of flexible elongated padding members disposed in parallel relationship on the board-like base member. This construction provides the mattress and like articles with proper hardness and flexibility. This effectively protects a sleeper from sinking into the mattress, thereby enabling him to maintain the ideal sleeping posture and sleep off his fatigue. In addition, since the area of contact between the body and the mattress is held at a minimum, the undesirable effect on skin respiration is eliminated.

It is another object of the invention to provide padding in which the flexible elongated padding members are semi-cylindrical in their cross-section and provided on their outer surface with many small projections. These flexible semi-cylindrical elongated padding members are effective for ensuring a smooth blood circulation because these members protect blood vessels against pressure which would be applied if the sleeper slept on a mattress with a hard outer plane. The small projections on the elongated padding members serve to promote blood circulation and activate functions of the internal organs by moderately stimulating the human body. The inventive padding therefore is most suitable for hypertension and persons having stiff shoulders.

It is another object of the invention to provide padding in which the semi-cylindrical elongated padding members are formed with perforations for ventilation. This arrangement, associated with a vertical movement of the flexible elongated padding members on the soft base member accompanying the movement of the human body on the mattress, is very effective for ventilating the mattress. Accordingly, patients and old people who use the mattress for many hours a day can enjoy a comfortable sleep despite the long continuous use of the mattress and troubles such as prickly heat can be effectively prevented.

It is another object of the invention to provide padding in which the elongated padding members are in parallel relationship on both sides of the board-like base member. This construction not only increases the above described effects of the inventive padding but enables the user to use either side of the mattress alternately thereby extending the life of the mattress.

It is another object of the invention to provide padding in which the elongated padding members are in parallel relationship on either side of the board-like base member and the elongated members provided on one side are offset in their cross-section from those provided on the other side. This arrangement increase the flexture of the elongated members thereby promoting ventilation.

It is still another object of the invention to provide padding in which the outer surface of the elongated padding members are coated with a suitable coating material, such as plastics, for preventing wear of the elongated padding members and keeping them moisture-free.

Other objects and features of the invention will become apparent from the description made hereinbelow with reference to the accompanying drawings in which:

FIGS. 1 (A) and (B) are views for comparing a sleeping posture of a person lying on a conventional mattress stuffed with foam rubber and one on a mattress stuffed with the inventive padding;

Figure 1:
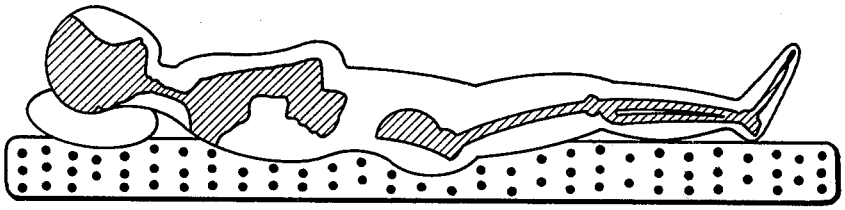
FIG. 1 (A) PRIOR ART
Figure 1:
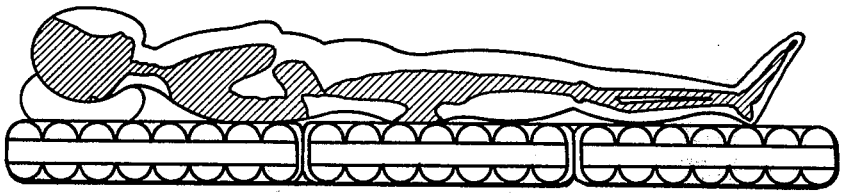
Figure 2:
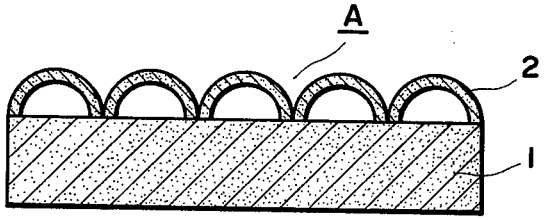
FIG. 2 is a sectional view showing a first embodiment of the invention.

Referring first to FIG. 2 which shows one preferred embodiment of the invention, the padding A consists of a soft board-like base member 1 and a plurality of flexible elongated padding members 2 disposed in parallel relationship on the outer surface of the base member 1. The base member 1 is made of a soft foamed synthetic resin material such, for example, as foamed urethane and has a board-like configuration with a desired thickness. The elongated padding members 2 are made of a relatively hard, flexible material, preferably foamed resin such as foamed polyethyrene, foamed resin made by mixing polyvinyl butyral with polyethylene or polypropylene, synthetic rubber and foamed butadiene. The elongated padding members 2 used in this embodiment are semi-cylindrical in their cross-section. The elongated padding members, however, need not be semi-cylindrical in cross-section but may be oval, semi-circular or any other desired shape. The elongated padding members 2 are bonded or otherwise fixed to the base member 1.

Figure 3:
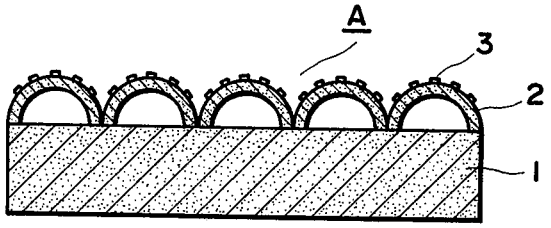
FIG. 3 is a sectional view showing a second embodiment of the invention.

FIG. 3 shows a second embodiment of the invention. This embodiment is different from the first embodiment in that the elongated padding members 2 are provided on the outer surface thereof with a number of small projections 3. These projections 3 are formed integrally with the padding members 2.

Figure 4:
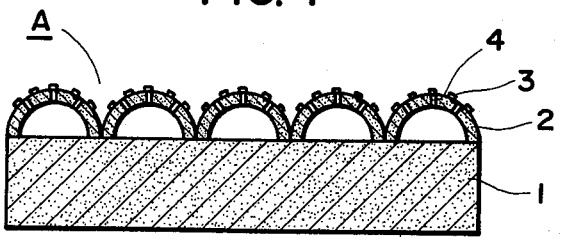
FIG. 4 is a sectional view showing a third embodiment of the invention.

FIG. 4 shows a third embodiment of the invention. In this embodiment, a desired number of perforations are formed in the elongated padding members 2 for ventilation.

Figure 5:
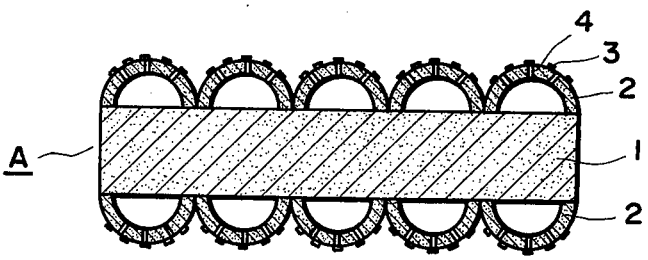
FIG. 5 is a sectional view showing a fourth embodiment of the invention.

FIG. 5 shows a fourth embodiment of the invention. In this embodiment, the semi-cylindrical elongated padding members 2 are in parallel relationship on both sides of the base member 1. It will be apparent from the figure that the two sides of the padding can be used alternately so that the advantageous effects of the padding are enhanced and the life of the padding is extended.

Figure 6:
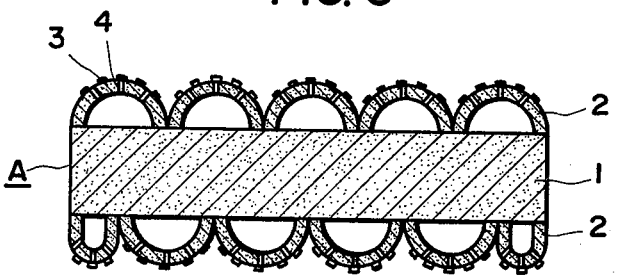
FIG. 6 is a sectional view showing a fifth embodiment of the invention.

FIG. 6 shows a fifth embodiment of the invention. This embodiment is similar to the one shown in FIG. 5 except the disposition of the elongated padding members 2 on one side relative to these on the other side. Namely, the elongated padding members on one side are offset in their cross-section from those on the other side. When the elongated padding members 2 are compressed due to the weight of the sleeper, force is applied to the base member 1 in the directions of arrows a (FIG. 8) and resilient force of the base member 1 affords a pleasant stimulus to the human body thereby promoting health.

Figure 7:
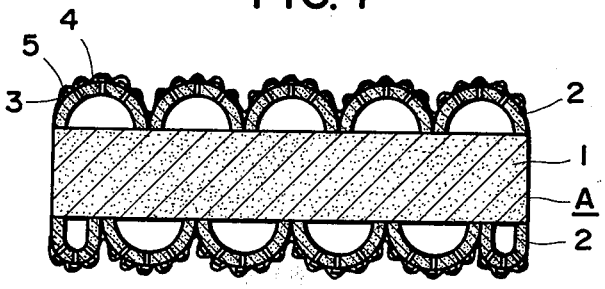
FIG. 7 is a sectional view showing a six embodiment of the invention.
Figure 8:
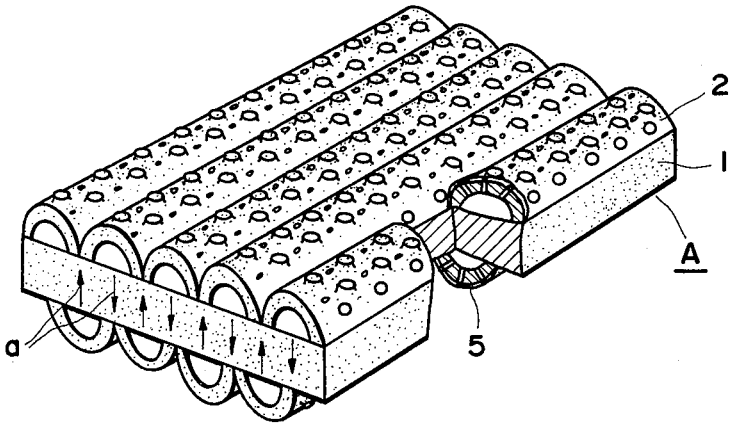
FIG. 8 is a perspective view showing the six embodiment of the invention.

In a sixth embodiment of the invention shown in FIGS. 7 and 8, the elongated padding members 2 are coated on the outer surface thereof with a suitable coating material such as plastics to form a film 5. This film 5 functions to keep the elongated padding members 2 moisture-free in a case where the elongated padding members 2 are made of a foamed resin with a high hygroscopic property, such as foamed polyurethane with a relatively low degree of foaming. The film 5 also functions to strengthen the elongated padding member 2 in a case where a foamed mixture of polyvinyl butyral and polyethyrene (or polypropylene) is used as the elongated padding member 2.

Figure 9:
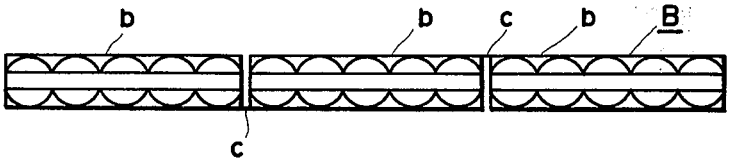
FIG. 9 is a view showing a mattress in which the inventive padding is used.

FIG. 9 shows a mattress B in which the inventive padding A is used. The mattress B is composed of three portions b each containing the padding A. The mattess B is thus foldable at boundary lines C.

What is claimed is:

1. Padding for mattresses and like articles comprising a soft board-like base member and a plurality of elongated padding members disposed in parallel relationship to each other on opposite sides of said base member, each of said elongated padding members having a substantially semi-cylindrical cross-section with its curved surface directed away from said base member and defining an air circulating space between adjacent elongated padding members, and a number of small projections provided on the upper curved surfaces of said elongated padding members, each of said small projections being sufficiently spaced apart from each adjacent projection to give moderate stimulus to the human body.

2. Padding for mattresses and like articles as defined in claim 1 wherein said elongated padding members provided on one side of said board-like base member are offset as viewed in cross-section from those provided on the other side.

3. Padding for mattresses and like articles as defined in claim 1 wherein said elongated padding members are formed with a plurality of perforations.

4. Padding for mattresses and like articles as defined in claim 3 wherein said elongated padding members are coated on the outer surfaces thereof with a synthetic resin material.

5. Padding for mattresses and like articles as defined in claim 1 wherein said padding members are devoid of any filling material therein.

6. Padding for mattresses and like articles as defined in claim 2 wherein said padding members are devoid of any filling material therein.

7. Padding for mattresses and like articles as defined in claim 3 wherein said padding members are devoid of any filling material therein.

8. Padding for mattresses and like articles as defined in claim 4 wherein said padding members are devoid of any filling material therein.

* * * * *